US006830242B2

(12) United States Patent
Merkli

(10) Patent No.: US 6,830,242 B2
(45) Date of Patent: Dec. 14, 2004

(54) DELIVERY DEVICE FOR REMOVING FOLDED PRINTED PRODUCTS

(75) Inventor: Peter Merkli, Oftringen (CH)

(73) Assignee: Muller Martini Holding AG, Hergiswil (CH)

( * ) Notice: Subject to any disclaimer, the term of this patent is extended or adjusted under 35 U.S.C. 154(b) by 0 days.

(21) Appl. No.: 10/224,407

(22) Filed: Aug. 21, 2002

(65) Prior Publication Data

US 2003/0047859 A1 Mar. 13, 2003

(30) Foreign Application Priority Data

Aug. 21, 2001 (EP) ..... 01810809

(51) Int. Cl.[7] ..... B65H 5/32

(52) U.S. Cl. ..... 270/52.29; 270/52.26; 198/644

(58) Field of Search ..... 270/52.26, 52.29, 270/52.18, 52.16, 52.14; 83/151, 154, 155, 155.1; 198/644

(56) References Cited

U.S. PATENT DOCUMENTS

| | | | | | |
|---|---|---|---|---|---|
| 1,750,622 | A | * | 3/1930 | Belluche | 270/52.18 |
| 3,032,336 | A | * | 5/1962 | Heigl et al. | 270/52.18 |
| 3,809,384 | A | * | 5/1974 | Zugel | 270/52.28 |
| 4,046,043 | A | * | 9/1977 | Kistner et al. | 83/425.4 |
| 4,076,232 | A | * | 2/1978 | Kistner et al. | 270/52.14 |
| 4,164,159 | A | * | 8/1979 | Marciniak | 83/280 |
| 4,260,145 | A | * | 4/1981 | Mebus et al. | 270/52.14 |
| 4,482,141 | A | * | 11/1984 | Moser | 198/644 |
| 4,498,663 | A | * | 2/1985 | Wamsley et al. | 270/52.04 |
| 5,086,681 | A | * | 2/1992 | Ruetschle et al. | 83/277 |
| 5,673,910 | A | * | 10/1997 | Wamsley | 271/259 |
| 5,967,503 | A | * | 10/1999 | Newsome | 270/52.04 |
| 6,267,366 | B1 | | 7/2001 | Graushar et al. | |
| 6,315,107 | B1 | * | 11/2001 | Muller et al. | 198/606 |

FOREIGN PATENT DOCUMENTS

| | | |
|---|---|---|
| CH | 358100 | 11/1961 |
| CH | 525 142 | 7/1972 |
| EP | 0 718 225 A2 | 6/1996 |
| EP | 0 917 965 A1 | 5/1999 |
| EP | 1024099 A1 | 8/2000 |
| EP | 1 072 546 A1 | 1/2001 |
| EP | 1 156 003 A2 | 11/2001 |
| JP | 6-191176 A | 7/1994 |

* cited by examiner

*Primary Examiner*—Patrick Mackey
(74) *Attorney, Agent, or Firm*—Venable LLP; Robert Kinberg

(57) ABSTRACT

Delivery device for removing printed products which straddle a saddle-shaped support of a conveying arrangement with the aid of circulating carriers. A gripping device comprises two rotating gripping members respectively positioned on the circumference of a rotating support between which the printed products are gripped and lifted off the conveying arrangement. Preferably, the gripping members have a curved outer shell surface that forms an essentially circular contour together with an outer shell surface of a support. The printed products are pulled off horizontally with initially high speed from the conveying arrangement and then transferred vertically to another conveying arrangement. The collision with the subsequent printed product is avoided even with high production capacity.

18 Claims, 3 Drawing Sheets

DELIVERY DEVICE FOR REMOVING FOLDED PRINTED PRODUCTS

CROSS-REFERENCE TO RELATED APPLICATION

This application claims the priority of European Patent Application No. 01810809.2 filed on Aug. 21, 2001, the disclosure of which is being incorporated herein by reference.

BACKGROUND OF THE INVENTION

The invention relates to a delivery device for removing folded printed products, which are transported straddling with the aid of circulating carriers on the saddle-shaped support of a conveying arrangement. The delivery device is provided with a gripping device for gripping the printed products, such that they can be transported away with the conveying arrangement.

Delivery devices of the aforementioned type have long been known in the print-processing industry and, in particular, are used to carefully lift off printed products such as brochures, newspapers and the like from a gathering section moving in longitudinal direction. The printed products lifted off the gathering section are deflected and are supplied, for example, to a device for trimming the top, bottom and front.

In particular, the gathering section has an endless gathering chain on which feeders deposit printed sheets that are removed from a stack for forming the printed products. Carriers are arranged evenly spaced along the gathering chain and are used to transport the folded printed sheets deposited on the chain. The carriers can be attached to the gathering chain, such that they can be adjusted for changing the spacing. For the so-called "selective binding," the printed products are selectively assembled and the thickness of the printed products can be changed in this way. The assembled printed products as a rule are bound, in particular in the region of the gathering chain, with the aid of a wire-stitching machine. In that case, the gathering chain is preferably a double-gathering chain.

In the high-performance range, the production speed is frequently limited by the capacity of the delivery device, which must lift and deflect the printed products carefully and, at the same time, without interruption. Further, the separate printed products must be lifted off the conveying track at a high enough speed, so that the following printed product does not collide with the previous one. In addition, the printed products must be gripped and lifted off with enough care, so that the printed products are not damaged and, in particular, no markings are created on the outside. For the "selective binding," it should furthermore be possible to remove printed products of different thickness and different formats with the same high capacity.

Swiss Patent No. CH-A-358 100 discloses an delivery device, which lifts up the printed products with a sword and then inserts the printed products between successively arranged roller pairs. The rotational axes of the respective roller pairs are directed parallel to the movement plane of the sword and perpendicular to its slanted movement components. The slanted orientation of the sword movement and the roller pairs, as well as a drive connection of the sword are dimensioned such that the printed products retain their horizontal conveying speed when they are lifted off. The printed products are deflected relatively sudden and without particular care with respect to the product. The production speed of the system is limited to 8,000 to 10,000 copies per hour, depending on the chain division and format.

A different delivery device is known from Swiss Patent No. CH-A-525 142, which is designed to permit a further increase in the speed. A lift-off sword is provided for this, which is moved along an elliptical path in such a way that the movement component above the chain apparatus is always oriented in advancing direction.

European Patent No. EP 1 072 546 A1 discloses an apparatus, comprising a star-shaped, rotatingly driven device, for removing the printed products above the gathering chain with the aid of tongue-like gripping members that lift the printed products from the gathering chain quickly and in the most stable position possible. The products are gripped by the tongue-shaped clamping members of a stationary sword and pulled in a 90° curve onto vertically moving belts. The rotating gripping members grip the printed products with a speed that is slightly higher than the transporting speed of the gathering chain. As a result, the printed products are pulled somewhat away from the carriers and thus do not hinder the outgoing printed product. A production speed of 20,000 to 25,000 copies per hour can be achieved, depending on the chain division and the number of rotating gripping members. The disadvantage of this arrangement is the comparatively large space required for the rotating gripping members and the high gripping forces necessary for controlling the acceleration and delay forces that occur during the deflection of the printed products. In addition, difficulties can arise during the processing of individual sheets in the case of a malfunction. In that case, the gripping members must automatically adjust to the thickness of such an individual sheet during the operation, which is very involved from a design point of view. During the individual readjustment from 21" to 14", the number of gripping arms must furthermore be increased from two to three.

SUMMARY OF THE INVENTION

It is the object of the present invention to develop an delivery device for removing folded printed products from a support, which permits an even higher production speed while still operating carefully and in a safe manner. In addition, it should have a compact design.

This object is solved with a delivery device having a gripping device for picking up and transporting off printed products in that the gripping device is provided with at least two rotating gripping members. The rotating gripping members are respectively positioned along the circumference of a rotating carrier between which the printed products are gripped and lifted off. The printed products are gripped by the rotating gripping members, which may be respectively positioned on the rotating carrier. As a result, the movement of the printed products is not limited to a circular path or a linear path, and thus, the movement of the printed products may have an optimum design. In particular, the movement path can be designed such that the collision with a following printed product associated with known delivery device at higher production speeds is avoided. According to the invention, a speed can be achieved at which the printed products are taken over virtually without impact by the gripping members, thus assuring a careful handling of the printed products. Furthermore, the printed products may be transferred to an additional conveying arrangement, for example onto belts, with a very small impact. Since rotating arms are not required according to the invention, a particularly compact design of the delivery device and gripping members may be obtained.

If, according to another modification of the invention, the gripping members have a beehive design, a particularly high production speed with careful handling of the printed products may be achieved. The largest diameter for the beehive-shaped gripping members is preferably dimensioned such that the resulting circumferential speed per cycle is higher than the chain division of the conveying arrangement. As a result of the somewhat higher, horizontal maximum circumferential speed of the beehive-shaped gripping members, as compared to the speed of the conveying arrangement, the printed product can be withdrawn optimally from the carriers. The beehive-shaped gripping members are preferably arranged in such a way that the printed products are displaced in the direction of the decreasing diameter during the carrier rotation. The printed products are consequently braked continuously in a horizontal direction and are transferred with a minimum horizontal speed to the conveying arrangement that is positioned at a right angle thereto.

Other advantageous features follow from the dependent patent claims, the subsequent description and the drawing.

BRIEF DESCRIPTION OF THE DRAWINGS

An exemplary embodiment of the invention is explained in further detail in the following with the aid of the drawings in which.

DETAILED DESCRIPTION OF THE INVENTION

Figure 1:
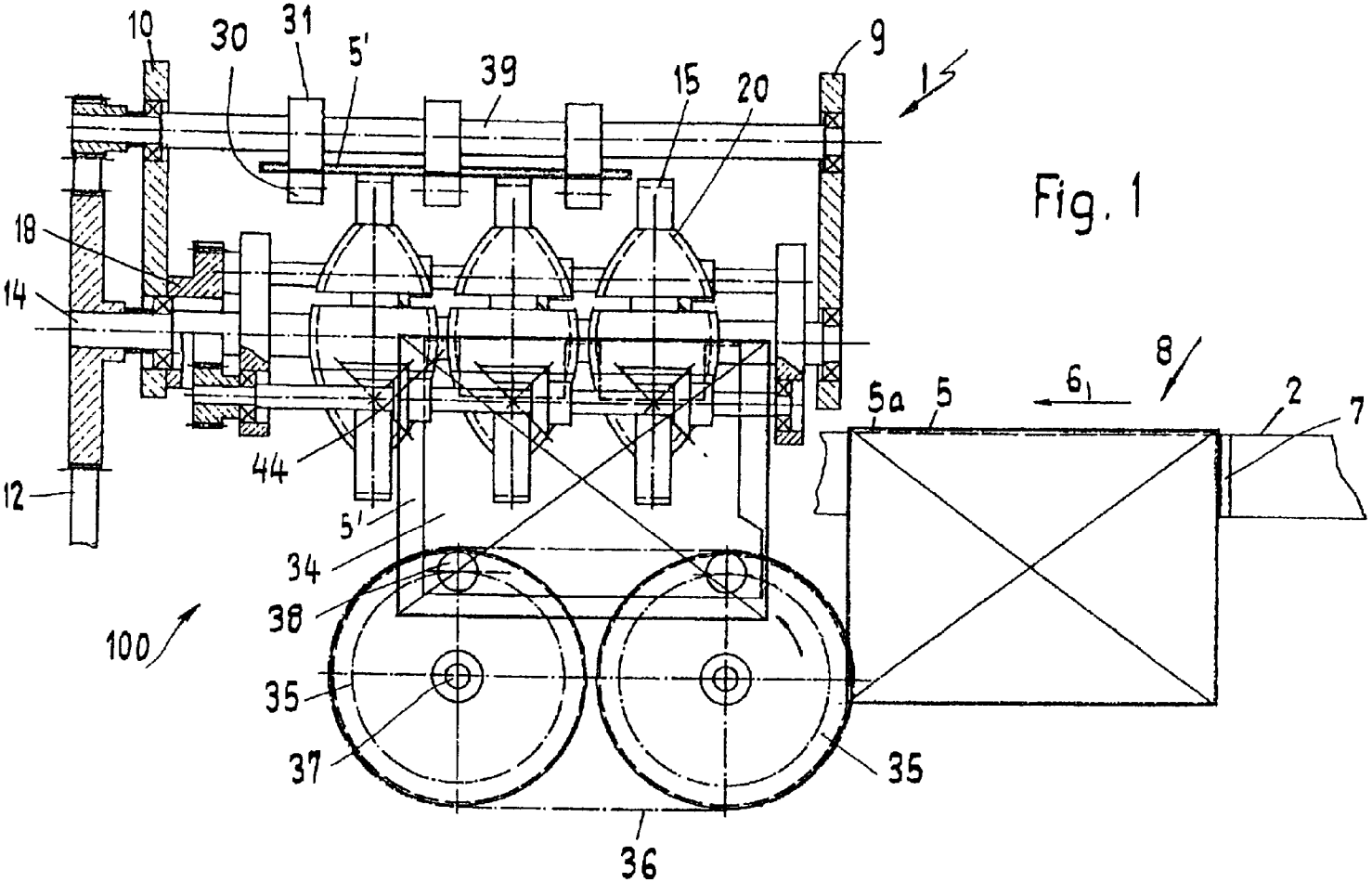
FIG. 1 schematically illustrates a vertical section through an delivery device according to the invention, as well as a portion of a conveying arrangement.
Figure 3:
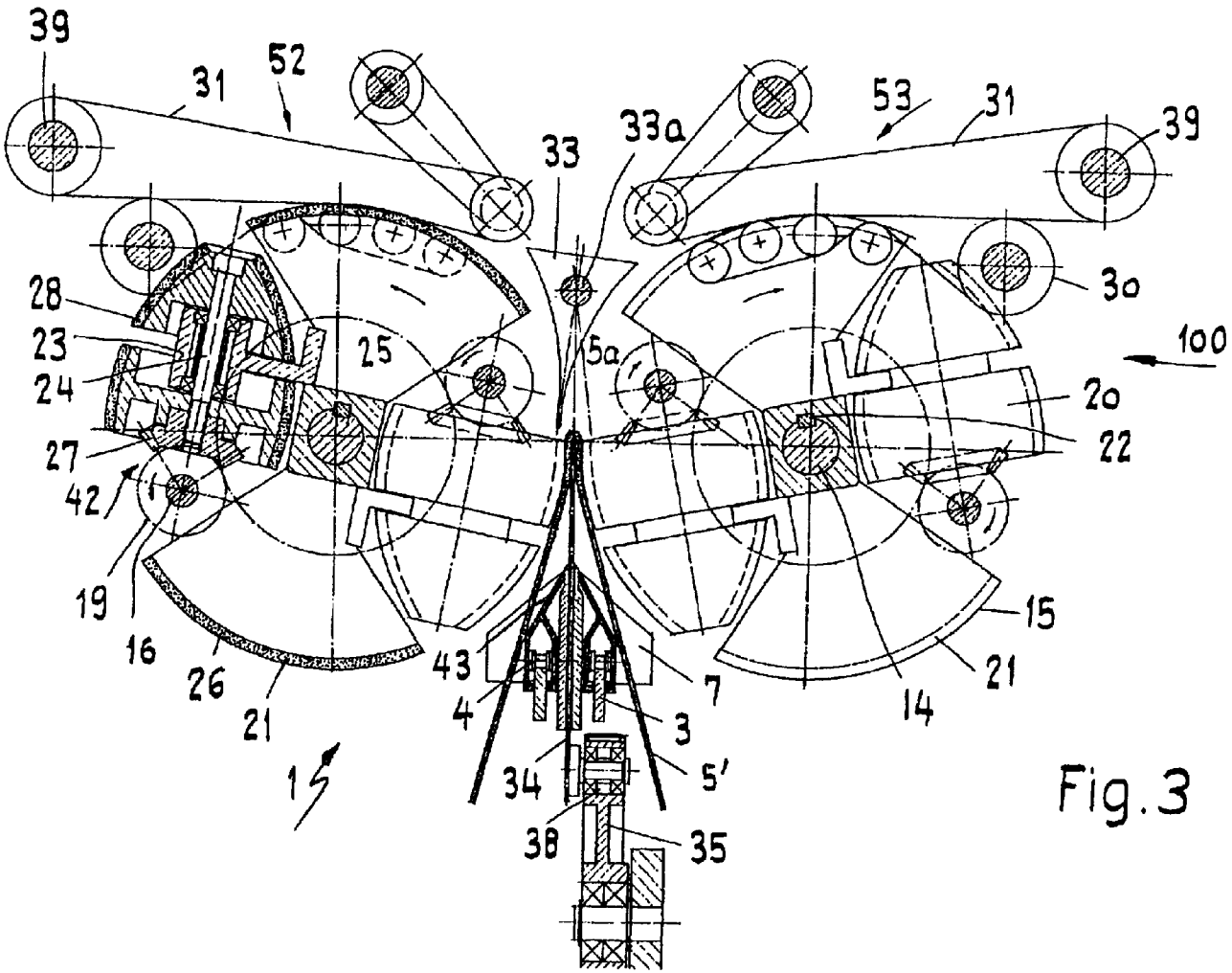
FIG. 3 is a schematic section through the delivery device and the conveying arrangement along the line III—III in FIG. 2.

The delivery device 1 is arranged in the region of a conveying arrangement 8, which conveys printed products 5 with a gathering chain 2 in the direction of arrow 6, as shown in FIG. 1. FIG. 3 shows that a double gathering chain comprising two individual chains 3 and 4 and a saddle-shaped support 43, on which the printed products 5 are conveyed straddling. In the process, the printed products 5 are carried along with the aid of carriers 7 that project on the side of gathering chain 2 or double chain 3, 4. The carriers 7 can be adjusted advantageously for changing the chain division. The printed products 5 as a rule include several printed sheets, which are dropped onto the gathering chain 2 or double chain 3, 4 via feeders, not shown herein. The folded printed sheets, used to form the printed products 5, can be opened up inside these feeders and deposited onto the gathering chain 2. The printed products 5, created with these sheets, therefore have respectively one fold 5*a* that extends in conveying direction of the gathering chain 2 or double chain 3, 4 during the transport of the product. The printed products 5 are transported straddling at an acute angle, which conforms to the saddle-shaped support 43. The printed products 5 can also be individual folded sheets.

A lift-off sword 34 is provided to convey the printed products 5 into the region where they are gripped by a gripping device 100 of delivery device 1. The sword is arranged between the two gathering chains 3 and 4, as shown in FIG. 3. FIG. 1 shows that the sword has a comb-like upper edge 44. The lift-off sword 34 is connected to and operated with two crank disks 35, such that it moves along a closed, circular or oval curved path in a vertical plane and, during each circulation, lifts a printed product 5 from the gathering chain 2 or double gathering chain 3, 4 and moves it into the pick-up range of the delivery device 1. The two crank disks 35 are positioned rotating on two shafts 37, wherein one of these shafts is a drive shaft and the two crank disks 35 are respectively connected to each other with an endless toothed belt or chain 36. The bearing arrangement 38 serves to position the lift-off sword 34 on the two crank disks 35, as shown in FIG. 3. Naturally, the movement of lift-off sword 34 is synchronized with the movement of the conveying arrangement 8. The lift-off sword 34 can also be stationary, wherein the printed products 5 are pushed onto the lift-off sword 34 and the gathering chain 2 is lowered, in a manner as known per se.

Figure 4:
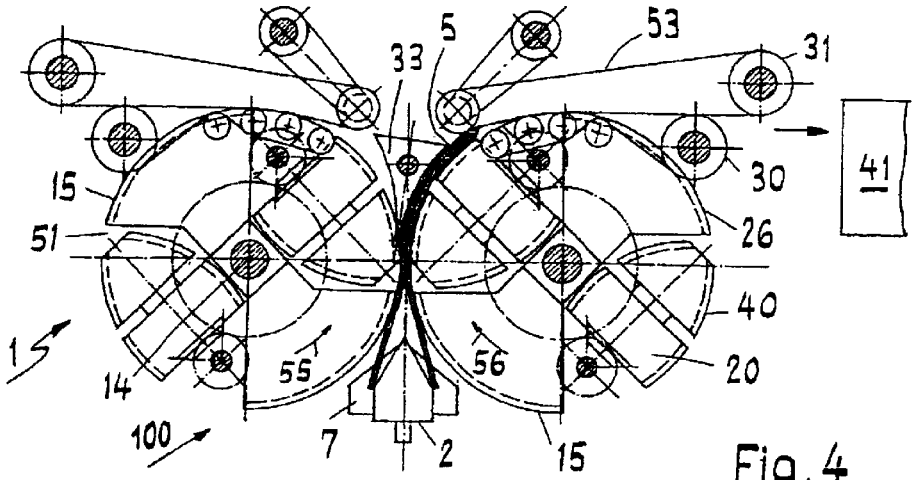
FIG. 4 is a section corresponding to FIG. 3, but showing a later operational state.
Figure 2:
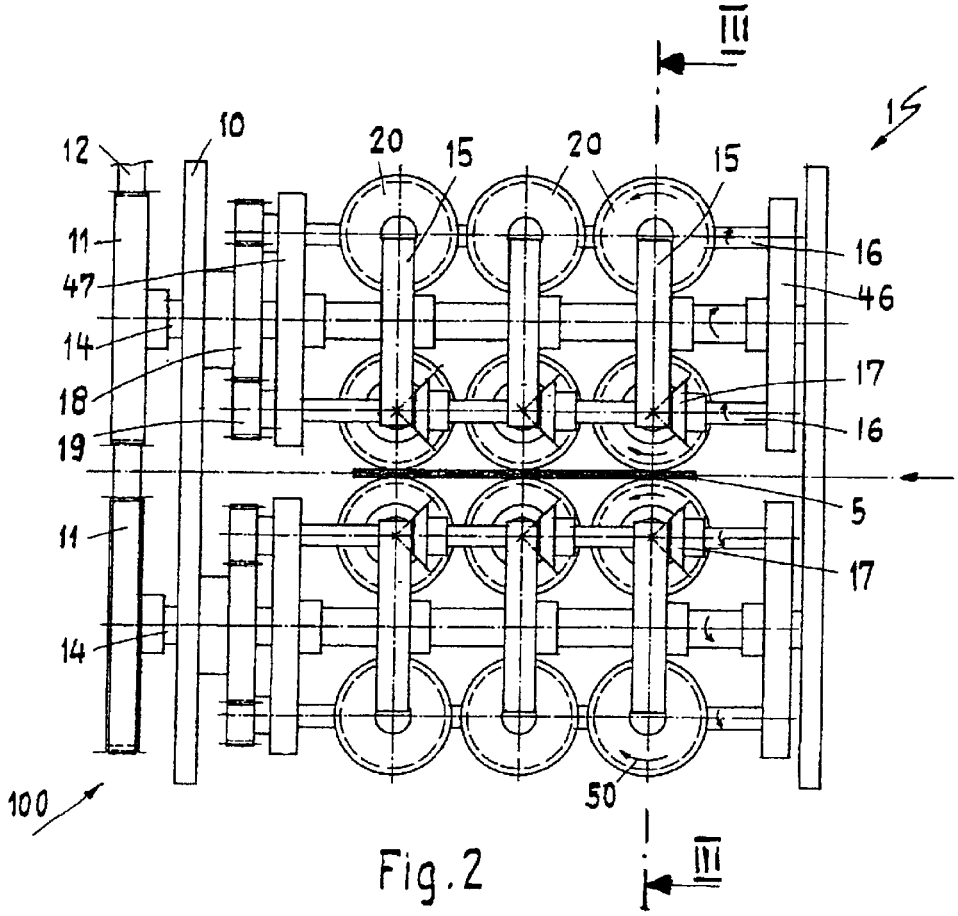
FIG. 2 is a schematic view from above of the delivery device according to the invention.

The delivery device 1 is provided with two bearing plates 9 and 10, on which two parallel extending drive shafts 14 are positioned at a distance to each other. FIG. 2 shows that the drive shafts 14 are rotationally connected to respectively one drive wheel 11, around which an endless toothed belt 12 is fitted. Three disk-shaped supports or carriers 15 are mounted on each drive shaft 14, so as to rotate along, which are arranged in pairs and at a distance to each other as shown. Also conceivable is a design with less than three or more than three supports 15 for each shaft 14. The supports 15 are driven such that they rotate in the counterclockwise direction, as shown in FIG. 4. The left supports 15 in FIG. 4 are driven in the counterclockwise direction, as shown with arrow 55, and the supports 15 on the right side are driven in the clockwise direction according to arrow 56. The rotational speeds and the circumferential speeds of supports 15 are respectively the same.

Gripping device 100 is described with reference to FIGS. 3 and 4. Two beehive-type rollers are positioned on each support or carrier 15, which are arranged diametrical to the respective drive shaft 14, as can be seen in FIGS. 3 and 4, and which form the gripping members 20. The rollers or gripping members 20 are respectively positioned on a shaft 24 that is attached with a holder 25 to the support 15. As shown, the supports 15 are respectively provided with a bearing 23, which holds one shaft 24. The shafts 24 extend respectively crosswise to the drive shafts 14.

The rollers or gripping members 20 are respectively driven with a bevel-gear drive 42, which comprises a wheel 27 that is rotationally connected to the shaft 24 and meshes with a wheel 17, which is mounted on a drive shaft 16. FIG. 2 shows that each drive shaft 16 is positioned rotating on two disks 46 and 47, which are respectively connected fixedly to one of the drive shafts 14. A spur gear 18 (sun gear) is attached centric to the drive shaft 14 and is fixedly connected to the side plate 10. Two planetary gears 19, arranged diametrically opposite each other, which are fixedly connected to one of the drive shafts 16, run off the spur gear. When the drive shafts 14 turn, the planetary gears 19 also turn synchronously via the spur gears 18 and the rollers or gripping members 20 turn synchronously via the drive shafts 16 and the bevel gears 42. Arrows 50 in FIG. 2 show the rotational directions of the rollers or gripping members 20.

Each roller or gripping member 20 is respectively arranged in a V-shaped gap 51 that is open toward the outside, as shown in FIG. 4. In addition, each roller or gripping member 40 may be provided with a curved outer shell surface 40, which forms a circular contour together with an outer shell surface 26 of support or carrier 15. The outer shell surfaces of the rollers or gripping members, 20 as well as the carriers 15 are provided with a rubber-elastic lining 28 and 21, as shown in particular in FIG. 3.

Two additional shafts 39 are positioned above the carriers 15 on the two bearing plates 9 and 10 and are also driven with toothed belts 12. These shafts respectively drive three endless top conveying belts 31, which respectively operate jointly with a bottom conveying belt 30 for the continued transport of printed products 5. FIG. 3 shows that the belts 31 and 30 form two conveying arrangements 52 and 53, between which a deflection roller 33 is arranged that feeds the printed products 5 selectively to the conveying arrangement 52 or 53. If the deflection roller 33 is in the position shown in FIG. 3, the printed products 5 are fed to the conveying arrangement 53. By pivoting the deflection roller 33 counterclockwise around a horizontal axis 33*a*, a position can be adjusted in which the printed products 5 are fed to the conveying arrangement 52. The deflection roller 33 is adjusted with control means that are not shown herein. The conveying arrangements 52 and 53 cause the printed products 5 to be deflected to an essentially horizontal plane. In the process, the printed products 5 are supplied, for example, to a cutting device 41 that is only indicated in FIG. 4, e.g. a three-side trimmer.

The operating mode for the delivery device 1 according to the invention is explained in the following.

FIG. 1 shows that the double gathering chain 2 conveys the printed products 5 in the direction of arrow 6 and thus into the region where they are picked up by the lift-off sword 34. With this lift-off sword 34, respectively one printed product 5 is picked up on the inside of fold 5*a* and is lifted up. FIGS. 1 and 3 show a printed product 5' that is picked up by the lift-off sword 34 and is lifted up. During the continued transport, the lift-off sword 34 then dips down once more between the two chains 3 and 4 and picks up the following printed product 5 and lifts it up in the same way. As shown clearly in FIG. 3, the lifted up printed product 5' is gripped in the region of fold 5*a'* by the rollers or gripping members 20, arranged in pairs. The lift-off sword 34 has comb-type design that corresponds to that of the rollers or gripping members 20, as mentioned in the above, so that the lift-off sword 34 is not picked up by the rollers or gripping members 20. As a result of the rotation of support or carrier 15, the picked up printed product 5' is accelerated in vertical upward direction. At the same time, a horizontal acceleration takes place in the conveying direction of the double gathering chain 2 and thus in the direction of arrow 6, which is caused by the rotation of the rollers or gripping members 20. This horizontal acceleration is at the highest value for the arrangement shown in FIG. 3 since the diameter D of these rollers 20 is largest in the pick-up region for these rollers or gripping members 20. During the further conveying of printed products 5', the diameter D of the rollers or gripping members 20 continues to get smaller and, accordingly, the horizontal speed of the printed product 5' decreases. FIG. 4 shows the printed product 5' in a phase, in which the smallest diameter D is effective. The fold 5*a'* in that case is already in the region of conveying arrangement 53. The printed product 5' is deflected into the region of conveying arrangement 53 through a corresponding adjustment of the deflection roller 33.

FIG. 4 shows the phase in which the printed product 5' is lifted up far enough to be nearly completely off the gathering chain 2. The horizontal speed of printed product 5' in that case is essentially zero and the product is conveyed by the conveying arrangement 53 and the supports 15, which grip the lower edge of the printed product 5'. The printed product 5' is then deflected to an essentially horizontal plane and is supplied to the cutting device 41 where it is trimmed on three sides.

Following a rotation of 180° by the support 15, the aforementioned conveying operation is repeated with the following printed product 5. The printed product 5 is thus picked up in the aforementioned manner by the emerging lift-off sword 34 and is moved to the effective range of three rollers or gripping members 20 that operate in pairs. If the printed product 5 is thicker or thinner than the printed product 5', then the lining 28 or 21 accordingly is compressed more or less. To accommodate even greater differences in the thickness, a design is conceivable for which the supports 15, for example, can be compressed pneumatically to the respective product thickness. For this, the distance between the two drive shafts 14 is changed based on the product thickness. The product thickness can be detected with sensors, not shown herein, and the corresponding value can be used to control the adjustment of the drive shafts 14.

The conveying arrangement 52 can be used to feed incomplete products 5 to a waste paper box that is not shown herein. Of course, the deflection roller 33 must then be adjusted accordingly. Incomplete printed products of this type can also be detected with a sensor. The deflection roller 33 is adjusted accordingly, so that these printed products are supplied with the conveying arrangement 52 to the waste paper box.

With the exemplary embodiment shown herein, the products 5 are picked up respectively by three roller pairs. In principle, a design is conceivable where the printed products 5 are picked up by only one roller pair or by more than three roller pairs. Also conceivable are designs where only one roller or gripping member 20, or more than two rollers or gripping members 20, are positioned on the supports or carriers 15. As previously mentioned, the lift-off sword 34 can be movable or stationary. In principle, other means can also be used to move the printed products 5 into the region where they are picked up by the rollers or gripping members 20.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. Delivery device for removing folded printed products comprising:

a conveying arrangement with a saddle-shaped support; and a gripping device operably associated with said conveying arrangement, said gripping device picking up printed products straddled over the saddle-shaped support of the conveying arrangement while the printed products are being conveyed with the conveying arrangement, wherein the gripping device has at least two rotating gripping members, which are respectively positioned on the circumference of a respective one of a pair of rotating supports, said printed products being gripped between the pair of rotating supports and transported off the conveying arrangement, and wherein the at least two rotating gripping members have a curved outer shell surface, each rotating gripping member forming an essentially circular outline together with an outer shell surface of the respective rotating support.

2. Delivery device for removing folded printed products comprising:

a conveying arrangement with a saddle-shared support, a gripping device operably associated with said conveying arrangement, said gripping device picking up printed products straddled over the saddle-shaped support of the conveying arrangement while the printed products are being conveyed with the conveying arrangement, and a drive shaft about which each respective rotating support rotates, wherein the gripping device has at least two rotating gripping members, which are respectively positioned on the circumference of a respective one of a pair of rotating supports, said printed products being gripped between the pair of rotating supports and transported off the conveying arrangement, and wherein the at least two rotating gripping members respectively rotate around a shaft, which is arranged at a distance to the drive shall for the respective rotating support and which extends crosswise to the drive shall of the respective rotating support.

3. The delivery device according to claims 1, wherein the at least two rotating gripping members are beehive-shaped.

4. The delivery device according to claim 1, wherein each respective rotating support is provided with two rotating gripping members, arranged diametrically opposite each other.

5. The delivery device according to claim 1, wherein at least one of the at least two rotating gripping members and the respective rotating supports is provided with a rubber-elastic lining.

6. The delivery device according to claim 1, further comprising a deflection roller arranged between the pair of respective rotating supports, said deflection roller adapted to deflect the printed products selectively either to the left or the right.

7. The delivery device according to claim 6, further comprising two upper conveying arrangements, each upper conveying arrangement being arranged on a respective side of the deflection roller whereby the two upper conveying arrangements respectively guide the printed products to different planes.

8. The delivery device according to claim 1, wherein the gripping device includes a lift-off sword that lifts the printed products individually off the conveying arrangement.

9. The delivery device according to claim 8, wherein the lift-off sword moves along a curved path or is arranged stationary.

10. The delivery device according to claim 8, wherein the conveying arrangement is provided with a double gathering chain and the lift-off sword is arranged between the two chains of the double gathering chain.

11. The delivery device according to claim 1, wherein the gripping device comprises two or more pairs of rotating supports.

12. The delivery device according to claim 1, further comprising a drive shaft about which each respective rotating support rotates, wherein the at least two rotating gripping members respectively rotate around a shaft, which is arranged at a distance to a drive shaft for the respective rotating support and which extends crosswise to the drive shall of the respective rotating support.

13. The delivery device according to claim 7, wherein the gripping device includes a lift-off sword that lifts the printed products individually off the conveying arrangement.

14. The delivery device according to claim 7, wherein the conveying arrangement is provided with a double gathering chain and the lift-off sword is arranged between the two chains of the double gathering chain.

15. The delivery device according to claim 1, wherein each respective rotating support is provided with two rotating gripping members, arranged diametrically opposite each other.

16. The delivery device according to claim 2, wherein each respective rotating support is provided with two rotating gripping members, arranged diametrically opposite each other.

17. The delivery device according to claim 2, further comprising a deflection roller arranged between the pair of respective rotating supports, said deflection roller adapted to deflect the printed products selectively either to the left or the right.

18. The delivery device according to claim 4, further comprising a deflection roller arranged between the pair of respective rotating supports, said deflection roller adapted to deflect the printed products selectively either to the left or the right.

* * * * *